United States Patent [19]

Hodge

[11] 4,098,429

[45] Jul. 4, 1978

[54] TRASH CONTAINER LID SYSTEM

[76] Inventor: Allan M. Hodge, 5852 Lomond Dr., San Diego, Calif. 92120

[21] Appl. No.: 810,493

[22] Filed: Jun. 27, 1977

[51] Int. Cl.[2] ..... B65D 43/14; B65D 51/04

[52] U.S. Cl. ..... 220/331; 220/1 T; 220/334; 220/335

[58] Field of Search ..... 220/1 T, 1.5, 331, 334, 220/335, 345, 110, 318; 294/73, 69; 214/302

[56] References Cited

U.S. PATENT DOCUMENTS

| | | | |
|---|---|---|---|
| 3,989,162 | 11/1976 | Hodge et al. | 220/331 |
| 4,014,457 | 3/1977 | Hodge | 220/331 |

*Primary Examiner*—George T. Hall

*Attorney, Agent, or Firm*—Poms, Smith, Lande & Glenny

[57] ABSTRACT

A trash container lid system for placement on top of large industrial trash bins of the type utilized in hotels, apartment houses, etc., in which a lid section is rotatably coupled to a trash bin via lever arms rotatably coupled at one end to the sides of the trash bin and at another end to the back of the lid section. A pair of brace members are fixedly attached to the outer surfaces of the sides of the lid and extend downwardly, each being in physical abutment with one of the lever arms during the time when the lid is closed and when the lid is partially open. Stop extensions on the inside of the lid sections cooperate with the stop extensions rising above the back of the trash bin for stopping the lid in a partially open position, the back section of the lid being counterbalanced for stabilization in this position.

11 Claims, 5 Drawing Figures

TRASH CONTAINER LID SYSTEM

BRIEF DESCRIPTION OF THE INVENTION

The present invention relates to a trash container lid system and, more particularly, to a trash container lid system having a stabilized, partially open position.

According to the invention, a trash container lid system is provided which is coupled to a trash bin via linkages or lever arms which are rotatably coupled to the lid assembly at one end and rotatably coupled to the trash container at another end. The lever arms are mounted on the back areas of the sides of both the lid assembly and the trash bin so that as the lid is raised, the back portion of the lid drops, describing an arc about the point of coupling of the lever arms to the trash bin. In the preferred embodiment, the lever arms or linkages are attached to the sides of the trash container and the lid section.

The lid is constrained to move with the linkages or lever arms in normal usage as trash is deposited in the bin; but the lid pivots about the pivot point at the rear of the lid, relative to both the linkage and the trash bin, to open wide as the bin is being dumped. This mode of operation is preferably accomplished through the use of first and second brace members which are fixedly attached to the outer surfaces of the sides of the lid and are in physical abutment with each of the lever arms during the closed and partially opened positions. The brace members form a bearing support for the lid against the lever arms.

The lid assembly may be counterbalanced in the back portion thereof for reducing the amount of force necessary to raise and lower the lid and for holding the lid in a partially opened position in a stabilized condition. Stop extensions extend downwardly from the inside of the top of the lid section and upwardly from the back of the container section to define the stabilized, partially open position. Upon dumping the container, whereby the entire assembly is inverted over the cab of a dump-truck, the lid will fall in a vertical position with the pivot arms resting against upward stop extensions at the top of the back surface of the container. The lid preferably has a raised rear or back portion. This configuration facilitates rearward pivoting movement of the lid to encompass the upper rear of a standard type commercial trash bin. Also, the raised rear shifts the weight of the lid to the rear and avoids the need for a counterweight.

An object of the present invention is the provision of an improved trash container lid assembly.

Another object of the invention is the provision of a trash container lid assembly having a stabilized, partially open position.

A further object of the invention is the provision of an improved trash container lid assembly which is sealed against the container in a closed position.

Yet another object of the present invention is the provision of a trash container lid system which is extremely convenient in use and simple in construction.

Other objects and many of the attendant advantages of the present invention will be readily appreciated as the same becomes better understood by reference to the following detailed description when considered in connection with the accompanying drawings in which like reference numerals designate like parts throughout the Figures thereof and wherein.

DETAILED DESCRIPTION OF THE DRAWINGS

Figure 1:
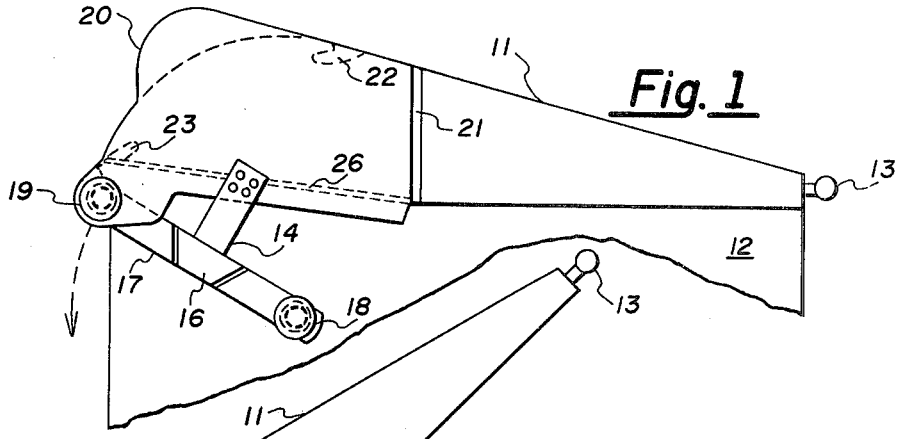
FIG. 1 is a side elevational view of the preferred embodiment of the present invention in a closed position.
Figure 2:
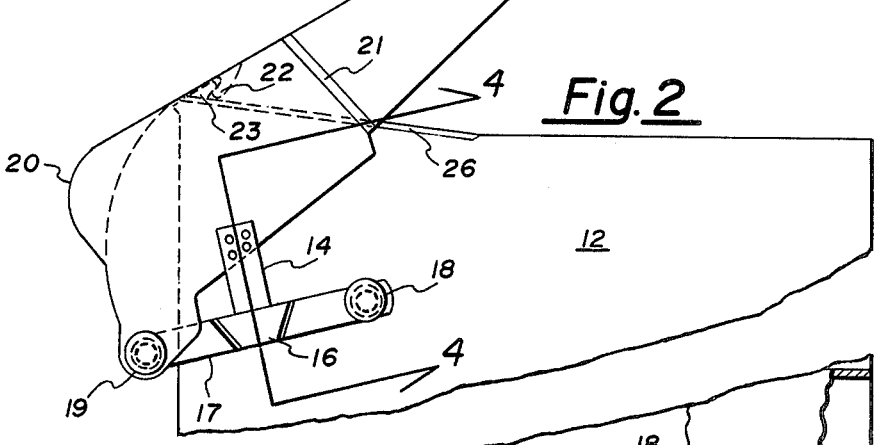
FIG. 2 is a side elevational view of the embodiment of FIG. 1 in a stabilized, partially opened position.
Figure 3:
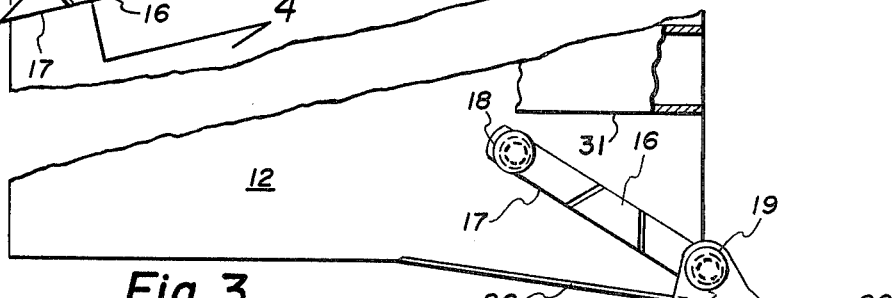
FIG. 3 is a side elevational view of the embodiment of FIG. 1 in an inverted position.

Referring to FIGS. 1, 2, and 3, a trash container lid 11 is coupled to a trash container 12. Trash container lid 11 has a handle 13 and carries brace members 14 (only one is shown, but the entire assembly is symmetrically constructed and is identical on each side of the bin and lid), which is in physical abutment with a doubler 16 of coupling arm 17. Coupling arm 17 is rotatably coupled at 18 to side of bin 12 and rotatably coupled at 19 to the rearward side portion of lid section 11. Lid section 11 has a counterweight area 20 which is filled with cement, for example, and has a bend-out 21 to allow a bottom rear section of the side portion to extend below the top edge of the lid portion with a seal 28 therebetween. Stop extension 22 extends downwardly from the inside top portion of lid section 11 and stop extension 23 extends upwardly from the rearward portion of trash bin 12 to cooperate in forming a stabilized, partially opened position as shown in FIG. 2.

Figure 4:
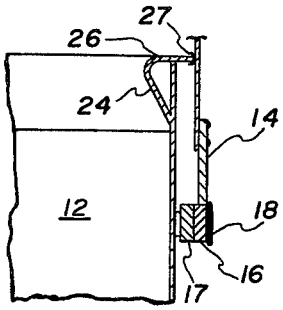
FIG. 4 is a sectional view taken along lines 4—4 of FIG. 2.
Figure 5:
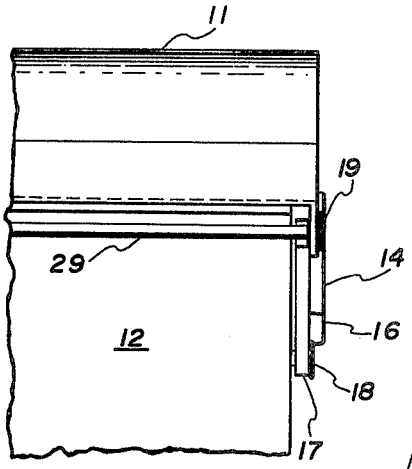
FIG. 5 is a partial back elevational view of the embodiment of FIG. 1.

Referring to FIGS. 4 and 5, brace 14 is shown being attached to the side of lid section 11 in an abutment with doubler 16 of pivot arm 17. Sealing fingers 27 extend from edge channel 24 of bin 12 and abut the inside surface of the side of trash bin lid 11. The sealing strip 26 is carried on the top surface of channel portion 24 of bin 12.

OPERATION

Referring back to FIGS. 1, 2, and 3, it can be seen that if handle 13 is pushed in an upper rearward direction, lever arms 17 will rotate counterclockwise as indicated by the dotted arrow in FIG. 1 until stops 22 and 23 come in contact with each other as shown in FIG. 2 and/or stabilizing bar 29 (FIG. 5) contacts the back of bin 12. At this time, trash can be placed in the bin without fear of the lid closing due to the counterweight section 20 in the back of lid 11. When it is desired to close the lid, handle 13 is merely pulled forwardly and downwardly until it is closed, as shown in FIG. 1. With pivot point 18 located below the center of balance of lid 11 for a position between the lid positions shown in FIGS. 1 and 2, both of these lid positions are stable gravity biased positions of the lid. When dumping the bin, the bin is inverted over the cab of a truck as shown in an inverted position in FIG. 3, with lid 11 falling in a completely open position. Here it is pointed out that brace members 14 physically abut the doubler section 16 of linkage 17 only in the closed position through the partially opened position, and when the trash bin is righted, as shown in FIG. 1, lid 11 will fall to its closed position with braces 14 absorbing much of the load against doubler section 16 of lever arms or linkages 17.

The bin 12 may be provided with lift pocket tubes, such as that shown at 31 in FIG. 3 for lifting and dumping the bin. Instead of pocket tubes, other known fittings may be provided on the bin 12 for lifting and inverting it.

Referring to FIGS. 4 and 5, sealing strip 26 is applied (on the top of the sides and front of the bin, i.e., the top edges of bin 12) with sealing fingers 27 abutting the inside surface of the sides of bin 11 to the rear of outward fold 21 to effect a complete seal when the lid is in a closed position.

Reference is made to my U.S. Pat. Nos. 3,836,036, granted Sept. 17, 1974; 3,951,302, granted Apr. 20, 1976; 3,989,162, granted Nov. 2, 1976; 3,994,415, granted Nov. 30, 1976; and 4,014,457, granted Mar. 29, 1977. The present system represents an advance over those disclosed in the above patents in that only simple pivoting movements are involved, and in that minimum modifications to the basic commercial trash bin are required.

It should be understood, of course, that the foregoing disclosure relates to only a preferred embodiment of the invention and that it is intended to cover all changes and modifications of the example of the invention herein chosen, for the purposes of the disclosure, which do not constitute departures from the spirit and scope of the invention. Thus, by way of example and not of limitation the linkage 17 could carry the member 14 to make selective engagement with the lid 11 at the upper end of member 14, or the linkage 17 could be of triangular configuration and directly abut lid 11. Interfitting guide members could be provided where members 14 and 16 abut. Accordingly, the present invention is only to be limited by the scope of the appended claims.

I claim:

1. A trash bin and lid assembly comprising:
a trash bin having an upper rim;
a lid for said trash bin having a first pivot point located on said lid near the rear of said lid;
means for mounting said lid for support and rotation about a second pivot point on said bin located below the upper rim thereof, when said assembly is in the upright position, with the center of gravity of said lid being forward of said second pivot point when said lid is in the closed position and to the rear of said second pivot point when said lid is in a partially open position;
means for stopping rearward movement of said lid in said partially open position when said bin is in the upright position;
linkage means interconnecting said two pivot points; and
means for constraining said lid to move with said linkage means to pivot about said second pivot point upon normal opening of said lid to said partially open position with the bin in the upright position, and for permitting said lid to pivot about said first pivot point to swing wide open when said lid is rotated to the up-side-down or dumping orientation.

2. A trash bin and lid assembly as defined in claim 1 further comprising:
means for restraining upward movement of the rear of said lid at or near the upper rear edge of said bin.

3. A trash bin and lid assembly as defined in claim 1 further comprising:
a rod extending across the rear of said lid assembly along said first pivot point, through two apertures in rearward extensions of said lid; and
means for engaging said rod at the upper rear edge of said trash bin to restrain movement of said rod and the rear edge of said lid in the direction toward the open side of said bin when said bin is in the upside-down orientation during dumping.

4. A trash bin and lid assembly as defined in claim 1 further comprising:
lifting pocket tubes mounted on said trash bin for facilitating the lifting, inverting and dumping of said bin.

5. A trash bin and lid assembly as defined in claim 1 further comprising:
means mounted on said trash bin for facilitating the lifting, inverting and dumping of said bin.

6. A trash bin and lid system comprising:
a trash bin;
a lid for said trash bin;
a linkage connected from a first point on said bin nearly under the center of balance of said lid and below the rim of said trash bin to a second point at the rear of said lid;
means for selectively constraining said lid to rotate about said first point and for supporting said lid from said first point when said bin is upright, and about said second point when said bin is upside-down.

7. A trash bin and lid assembly as defined in claim 6 further comprising:
means mounted on said trash bin for facilitating the lifting, inverting and dumping of said bin.

8. A trash bin and lid assembly as defined in claim 7 wherein said lid has a raised back portion.

9. A trash bin and lid assembly as defined in claim 7 further comprising:
counterweighting means mounted at the rear of said lid.

10. A trash bin and lid assembly comprising:
a trash bin having an upper rim;
a lid for said trash bin having a first pivot point located on said lid near the rear of said lid;
means for mounting said lid for support and rotation about a second pivot point on said bin located below the upper rim thereof, when said assembly is in the upright position, with the center of gravity of said lid being forward of said second povot point when said lid is in the closed position and to the rear of said second pivot point when said lid is in a partially open position;
means for stopping rearward movement of said lid in said partially open position when said bin is in the upright position;
linkage means interconnecting said two pivot points;
means for constraining said lid to move with said linkage means to pivot about said second pivot point upon normal opening of said lid to said partially open position with the bin in the upright position, and for permitting said led to pivot about said first pivot point to swing wide open when said lid is rotated to the upside-down or dumping orientation; and
said constraining means including means secured to said lid for engaging said linkage means for one direction of ratation of said lid relative to said linkage, but not for the opposite direction of relative motion.

11. A trash bin and lid assembly comprising:
a trash bin having an upper rim;
a lid for said trash bin having a first pivot point near the rear of said lid;
means for mounting said lid for support from and rotation about a second pivot point on said bin located below the upper rim thereof when said bin is in the upright position;

means for stopping rearward movement of said lid in a partially open position when said bin is in the upright position;

linkage means interconnecting said two pivot points;

means for constraining said lid to move with said linkage means to pivot about said second pivot point upon normal opening of said lid to said partially open position with the bin in the upright position, and for permitting said lid to pivot about said first pivot point to swing wide open when force is applied to said lid directed away from said bin; and said constraining means including means secured to said lid for engaging said linkage means for one direction of rotation of said lid relative to said linkage, but not for the opposite direction of relative motion.

* * * * *